US007066425B2

(12) United States Patent
Cornier et al.

(10) Patent No.: US 7,066,425 B2
(45) Date of Patent: Jun. 27, 2006

(54) DEVICE WITH RETRACTABLE ANTI-ROLL MEANS, AND USE THEREOF IN WIRE DISPENSING REELS

(75) Inventors: Jean-Claude Cornier, Annecy le Vieux (FR); Gilles Mollard, Les Contamines Mont Joie (FR)

(73) Assignee: Thermocompact, Metz Tessy (FR)

( * ) Notice: Subject to any disclaimer, the term of this patent is extended or adjusted under 35 U.S.C. 154(b) by 181 days.

(21) Appl. No.: 10/485,185

(22) PCT Filed: Jul. 19, 2002

(86) PCT No.: PCT/FR02/02579

§ 371 (c)(1),
(2), (4) Date: Jan. 28, 2004

(87) PCT Pub. No.: WO03/011730

PCT Pub. Date: Feb. 13, 2003

(65) Prior Publication Data

US 2004/0188560 A1 Sep. 30, 2004

(30) Foreign Application Priority Data

Jul. 30, 2001 (FR) ..... 01 10357

(51) Int. Cl.
*B65H 75/12* (2006.01)

(52) U.S. Cl. ..... 242/614; 242/611; 188/30

(58) Field of Classification Search ..... 242/614, 242/611, 611.1; 188/30, 136; 301/45
See application file for complete search history.

(56) References Cited

U.S. PATENT DOCUMENTS 3,836,059 A 9/1974 Lauen et al.
4,648,853 A * 3/1987 Siegfried ..... 446/448

OTHER PUBLICATIONS

International Search Report dated Oct. 31, 2002, Application No. PCT/FR02/02579.

* cited by examiner

*Primary Examiner*—John Q. Nguyen
(74) *Attorney, Agent, or Firm*—RatnerPrestia

(57) ABSTRACT

The invention a device with retractable anti-roll means designed in particular for a wire dispensing reel (10) having a cylindrical body (11) and end flanges (12, 13). The end flange (12) comprises a circular peripheral rolling edge (2) provided with slots (15*a*–15*f*) wherein slide elastic blades (5*a*–5*f*) the ends of which constitute retractable radial anti-roll projections (3*a*–3*f*). The elastic blades (5*a*–5*f*) are integral with a coaxially operated ring (4) whereof the rotation enables to project or retract the radial anti-roll projections (3*a*–3*f*). Thus it is possible to selectively allow the reel to turn by retracting the radial anti-roll projections (3*a*–3*f*), or to lock the reel in rotation by extending the radial anti-roll projections (3*a*–3*f*)

11 Claims, 7 Drawing Sheets

DEVICE WITH RETRACTABLE ANTI-ROLL MEANS, AND USE THEREOF IN WIRE DISPENSING REELS

TECHNICAL FIELD OF THE INVENTION

This is a U.S. National Phase of International Application No. PCT/FR02/02579 filed Jul. 19, 2002.

The present invention relates to means for controlling and adapting the rolling capacities of a rolling flange delimited by a peripheral rolling edge.

The invention finds an application in wire dispensing reels in particular, in which the rolling capacity of the reel on the peripheral edges of its end flanges can be controlled and modified.

The invention stems from observing the conditions of use of wire dispensing reels and in particular spark erosion electrode wire dispensing reels.

For use in spark erosion machines, the electrode wire is packaged on a reel comprising a cylindrical body flanked by two end flanges of larger diameter with a circular rolling edge. The circular shape of the rolling edges of the end flanges is rendered mandatory by the applicable standards, and allows the reel to turn freely when it is being filled.

During use for spark erosion machining, the same spark erosion machine must be able to use a plurality of different electrode wires in succession. It is then routinely necessary to change the reel of wire, and as a result of this it is necessary to store easily one or more reels of wire in the vicinity of the spark erosion machine. Because of the circular shape of the end flanges, a reel placed on the floor or on a shelf with its axis horizontal tends to roll freely if the support plane is not perfectly horizontal. This results in a risk of the reel falling off or of unintentional dispensing of the wire.

If it is required to store the reel with its axis vertical, the reel then resting on the outside face of one of its end flanges, the turns of the wire packaged on the reel tend to shift because of their weight, and can overlap in a random fashion. This results in a risk of irregular dispensing of the wire from the reel when the latter is used afterward on the spark erosion machine, and such irregularities can interfere with the operation of the spark erosion machine, to the point of complete stoppage of the machine, which necessitates the intervention of an operator.

It is therefore preferable to store the reels with their axis horizontal, preventing any lateral movement of the turns of wire. However, means are then required for selectively controlling the rolling capacity of the reel on a support plane.

Providing reels whose end flanges are of polygonal shape, rather than circular, has already been envisaged, this shape therefore opposing rolling of the reel resting tangentially with its two end flanges on a support plane. However, the reel then no longer conforms to the applicable standards, and cannot be rolled satisfactorily to fill it.

The document U.S. Pat. No. 3,836,059 A discloses a reel in which one of the flanges is provided with a diametral slideway in which can slide a tongue adapted to assume a retracted position allowing rolling of the reel and a projecting position in which one end of the tongue projects and opposes free rolling of the reel.

When the tongue is in the projecting position, the reel can still rotate through an angle exceeding 180°.

In other words, the anti-rotation means are not very effective, and the operator must beware of the relative position of the reel when he wishes to move the tongue to the projecting position, i.e. he must position the reel so that the tongue is away from the floor.

Furthermore, to prevent the reel rotating more than 180° before it is stopped by the tongue, the operator must consider the relative position of the tongue and the floor, to position the tongue on the side to which rolling is probable. This complicates use, and the device is not satisfactory for frequent use of different reels of spark erosion wire.

SUMMARY OF THE INVENTION

The problem proposed by the present invention is that of designing a structure for controlling simply and effectively the rolling capacity of a rolling flange delimited by a peripheral rolling edge, whilst retaining the circular shape of the peripheral rolling edge of the flange in order to comply with the applicable standards.

The invention must be applicable to wire dispensing reels and in particular to spark erosion electrode wire dispensing reels, which are interchanged frequently.

The invention also aims to provide a device that is sufficiently simple and of sufficiently low cost to be adapted to reels without significantly increasing the cost of production and use.

To achieve the above and other objects, the invention provides a device with retractable anti-rolling means, comprising a circular rolling flange delimited by a peripheral rolling edge provided with at least one radial anti-rolling projection selectively movable in a radial direction between a deployed position and a retracted position, to oppose or selectively allow rolling of the rolling flange on its peripheral rolling edge; according to the invention there is provided a plurality of retractable radial anti-rolling projections, angularly distributed along the periphery of the rolling flange, and simultaneously moved in a radial direction between a deployed position and a retracted position by a single controlling member that can be actuated by the user.

As a result, the user can easily achieve effective limitation of the angle through which the reel can roll, by maneuvering a single controlling member, and without having to consider the position of the radial anti-rolling projections.

In an advantageous embodiment, the radial anti-rolling projections are driven in radial movement by a coaxial controlling ring mounted on a face of the rolling flange so that it can rotate between a first angular limit position in which the radial anti-rolling projections project and a second angular limit position in which the radial anti-rolling projections are retracted within a circular contour defined by the peripheral rolling edge.

In an advantageous convenient embodiment, each radial anti-rolling projection consists of the external end of a respective leaf spring extending tangentially from the peripheral edge of the coaxial controlling ring and an oblique intermediate portion of which slides longitudinally in bearing engagement with guides on the rolling flange. Thanks to their elasticity, the radial anti-rolling projections can be moved toward the-deployed position without having to consider the possibility of one of the radial projections bearing on the floor and whose deployment is thereby prevented. It will be deployed as soon as the reel has rolled a few degrees.

The radial anti-rolling projections on the flange can advantageously move radially in slots in the peripheral rolling edge of the rolling flange, and the perimeters of the slots constitute said guides of the rolling flange.

The coaxial controlling ring is preferably retained in each of its angular limit positions by rotation braking means.

Also, the coaxial controlling ring can advantageously be removably fastened to the rolling flange.

The invention also consists in application of a device as defined hereinabove with anti-rolling means for controlling rolling of a wire dispensing reel, the wire dispensing reel comprising a cylindrical body flanked by two end flanges of larger diameter, at least one of said end flanges comprising said device with anti-rolling means.

In said application, said rolling flange of the device with anti-rolling means can advantageously of itself constitute the end flange of the wire dispensing reel.

A device with anti-rolling means can advantageously be fitted to each of the end flanges of the wire dispensing reel.

In this case, the retractable radial anti-rolling projections of the first end flange can advantageously be interleaved angularly between the retractable radial anti-rolling projections of the second end flange.

The invention can find one application in the production of special wire dispensing reels, comprising a cylindrical body flanked by two end flanges of larger diameter with a circular peripheral rolling edge, wherein at least one of the end flanges comprises peripheral slots adapted to receive and guide leaf springs of a coaxial controlling ring of a device as previously defined.

The invention can find one application in the production of controlling rings for a device as previously defined with anti-rolling means, said ring comprising leaf springs extending tangentially from the peripheral edge of the controlling ring.

BRIEF DESCRIPTION OF THE DRAWINGS

Other objects, features and advantages of the present invention will emerge from the following description of particular embodiments, given with reference to the accompanying drawings, in which.

DESCRIPTION OF THE PREFERRED EMBODIMENTS

In the embodiment of FIGS. 1 to 4, a device in accordance with the invention with anti-rolling means comprises a rolling flange 1 delimited by a circular peripheral rolling edge 2 provided with radial anti-rolling projections such as the projections 3*a*, 3*b*, 3*c*, 3*d*, 3*e* and 3*f*. In the projecting position shown in FIG. 1, the radial anti-rolling projections 3*a*–3*f* project radially from the peripheral rolling edge 2, whereas in FIG. 3 the radial anti-rolling projections are not visible because they are entirely retracted to allow rolling of the rolling flange 1 on its peripheral rolling edge 2.

Figure 1:
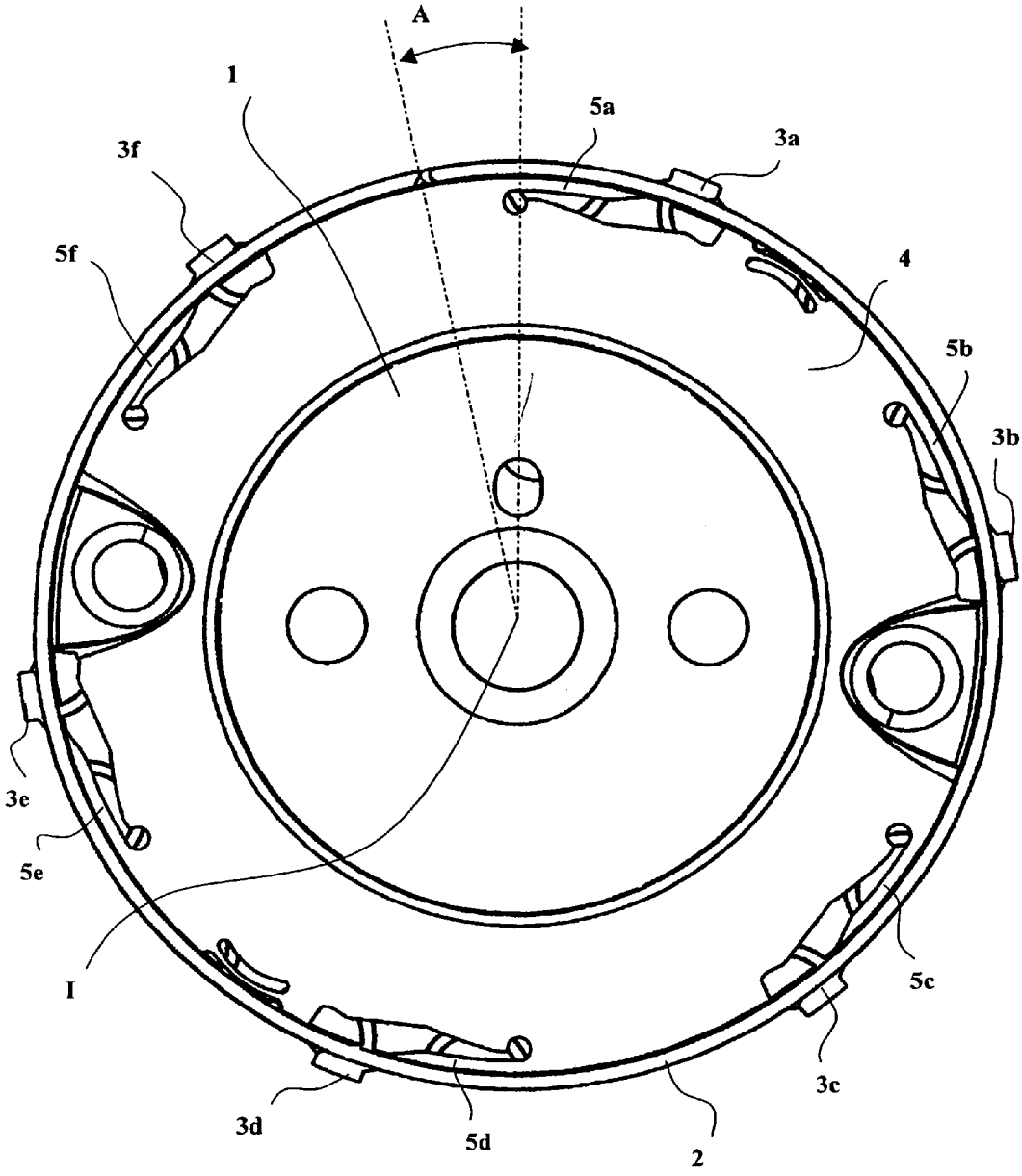
FIG. 1 is a front view of one embodiment of a device in accordance with the invention with anti-rolling means, with the radial anti-rolling projections in a projecting position.
Figure 2:
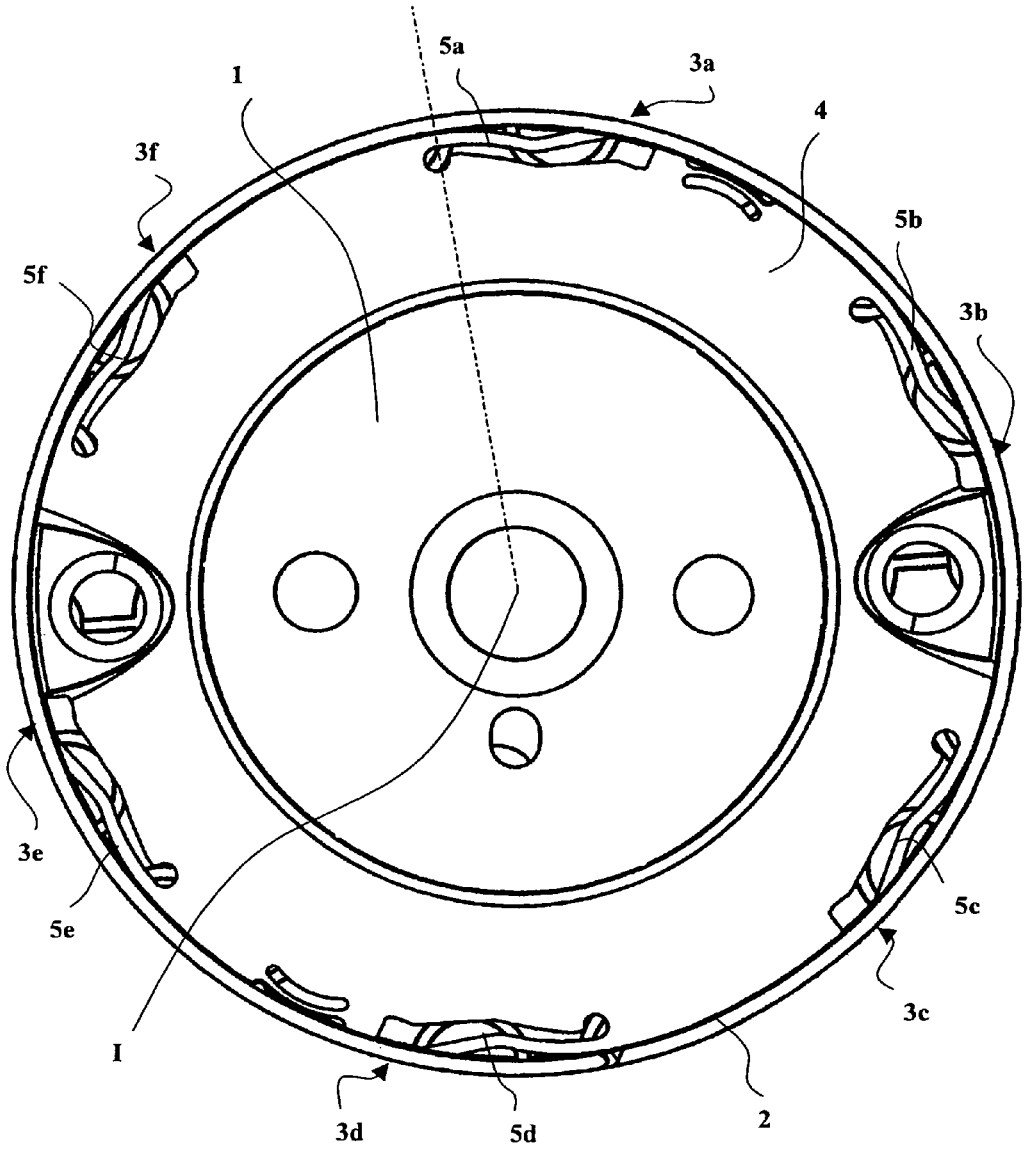
FIG. 2 is a front view of the FIG. 1 device, with the radial anti-rolling projections in a retracted position.

The radial anti-rolling projections 3*a* to 3*f* are moved radially, between their FIG. 1 projecting position and their FIG. 2 retracted position, by a coaxial controlling ring 4 mounted on the rolling flange 1 to rotate about the axis I of said flange. For example, the coaxial controlling ring 4 is mounted on the anterior face of the rolling flange 1 so that it can rotate through a rotation angle A (FIG. 1), between a first angular limit position (FIG. 1) in which the radial anti-rolling projections 3*a*–3*f* project and a second angular limit position (FIG. 2) in which the radial anti-rolling projections 3*a*–3*f* are entirely retracted.

Figure 3:
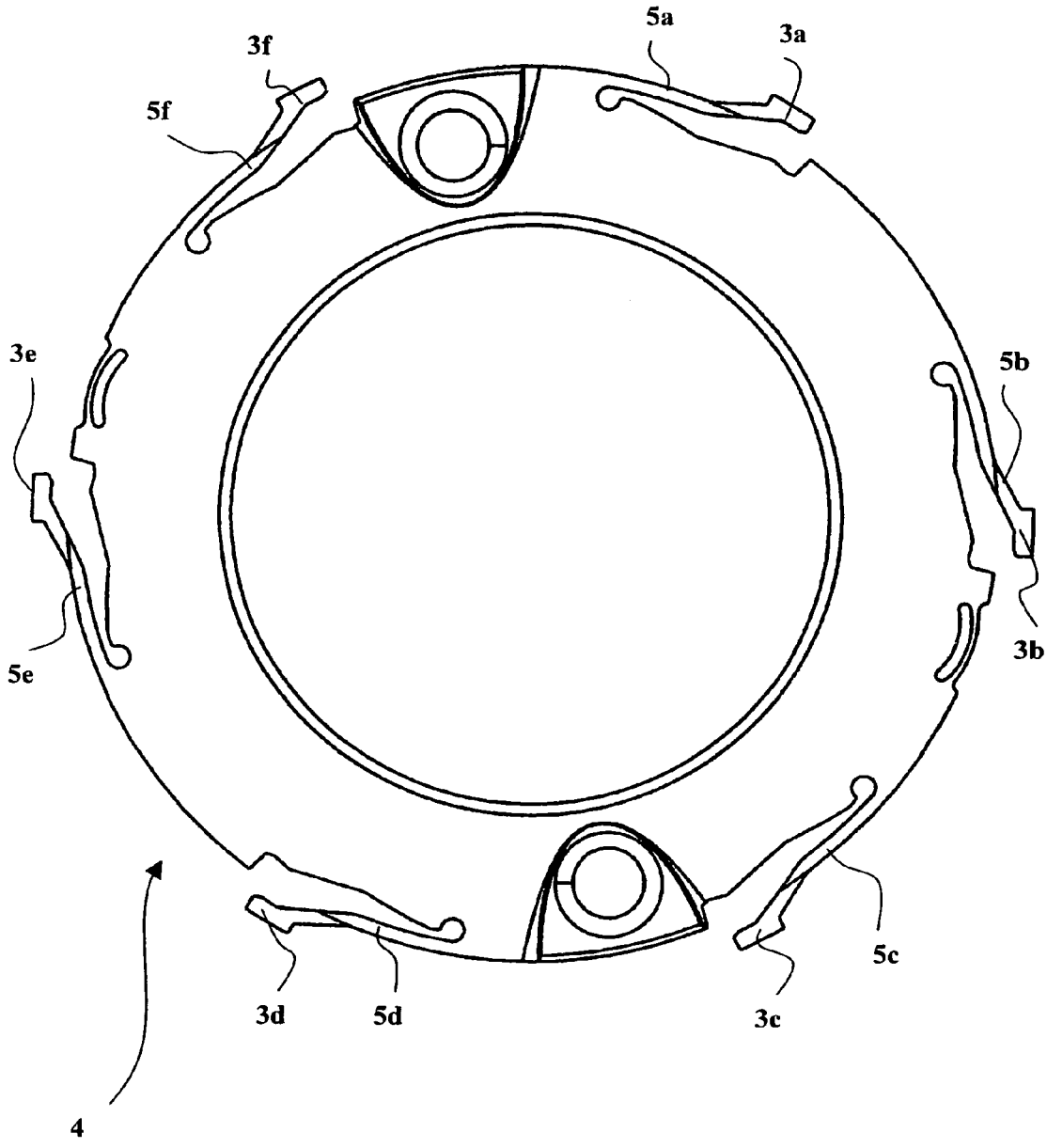
FIG. 3 is a front view of a coaxial controlling ring in the embodiment of FIGS. 1 and 2.
Figure 4:
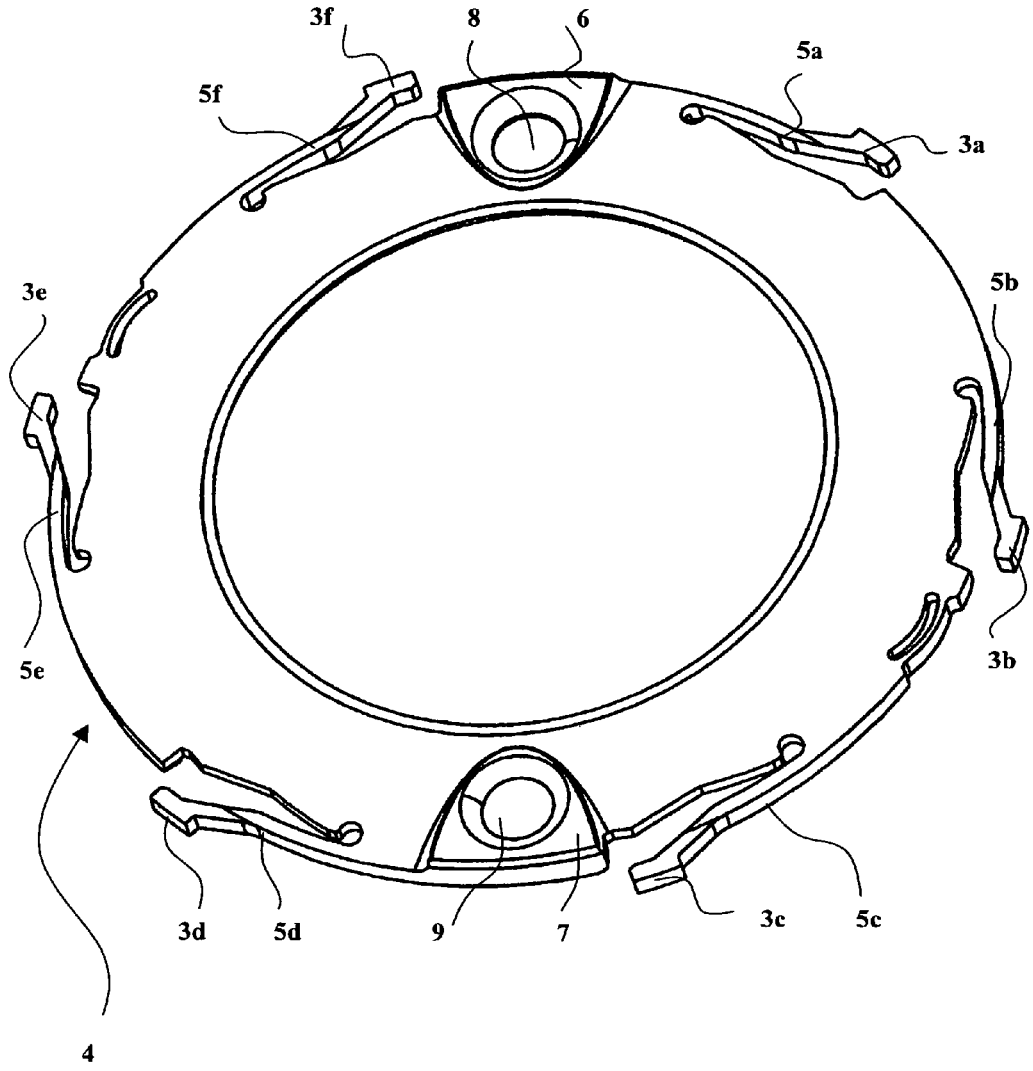
FIG. 4 is a perspective view of the coaxial controlling ring from FIG. 3.

FIGS. 3 and 4 show the structure of the coaxial controlling ring 4. There are shown again the radial anti-rolling projections 3*a* to 3*f*, which, in this embodiment, each consist of the external end of a corresponding leaf spring 5*a*, 5*b*, 5*c*, 5*d*, 5*e* and 5*f* that develops tangentially from the peripheral edge of the coaxial controlling ring 4. In the rest position, the leaf springs 5*a*–5*f* diverge from the coaxial controlling ring 4 to which they are fastened at their end opposite their free end the latter respectively constituting one of the radial anti-rolling projections 3*a* to 3*f*.

In the assembled position shown in FIGS. 1 and 2, when the coaxial controlling ring 4 is engaged on the rolling flange 1, an oblique intermediate portion of each leaf spring 5*a*–5*f* slides longitudinally bearing on guides of the rolling flange 1. In the embodiment shown, the guides of the rolling flange 1 consist of the perimeter of a slot 15*a*–15*f* in the peripheral rolling edge 2 of the rolling flange 1, slot in which one of the radial anti-rolling projections 3*a*–3*f* and the leaf spring 5*a*–5*f* that carries it slide to move from the FIG. 1 projecting position to the FIG. 2 retracted position and vice versa.

In the embodiment shown in FIGS. 1 to 4, the coaxial controlling ring 4 is simply pressed onto an anterior face of the rolling flange 1, and is retained on the rolling flange 1 by engagement of the leaf springs 5*a*–5*f* in the corresponding slots in the peripheral rolling edge 2 of the rolling flange 1.

The coaxial controlling ring 4 is preferably retained in each of its angular limit positions (FIG. 1 or FIG. 2) by rotation braking means whose implementation will be obvious to the person skilled in the art of molded plastics material objects.

The rolling flange 1 and the coaxial controlling ring 4 can each be molded from a plastics material. It will be noted that, to facilitate driving it in rotation about the axis I, the coaxial controlling ring 4 can be provided with asperities or recesses on its external face, for example two diametrically opposed regions 6 and 7 of increased thickness each provided with a respective hole 8 or 9 conformed for the insertion of a user's fingertip.

Figure 5:
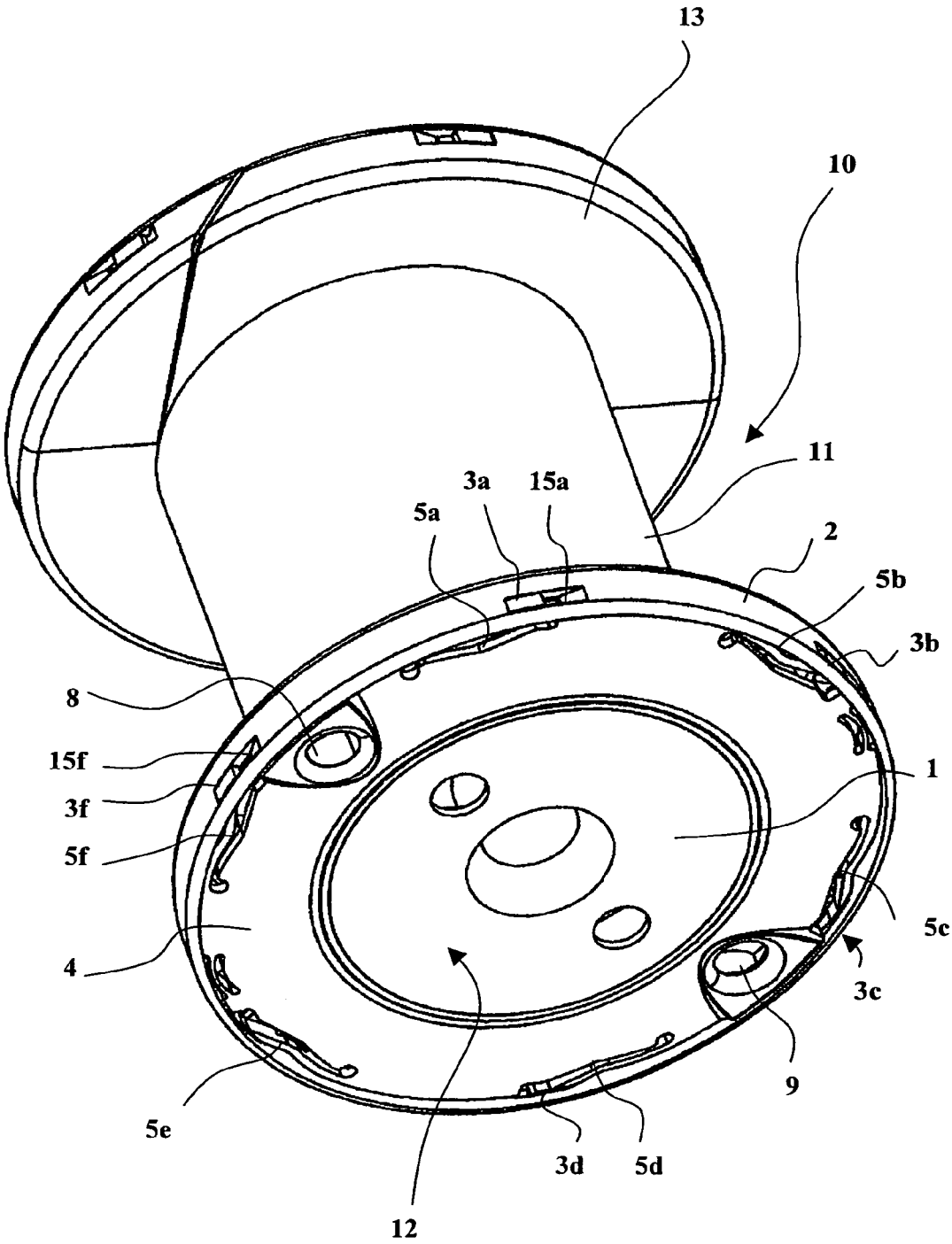
FIG. 5 is a perspective view of a reel provided with a device according to the invention with anti-rolling means, the radial anti-rolling projections being in a retracted position
Figure 6:
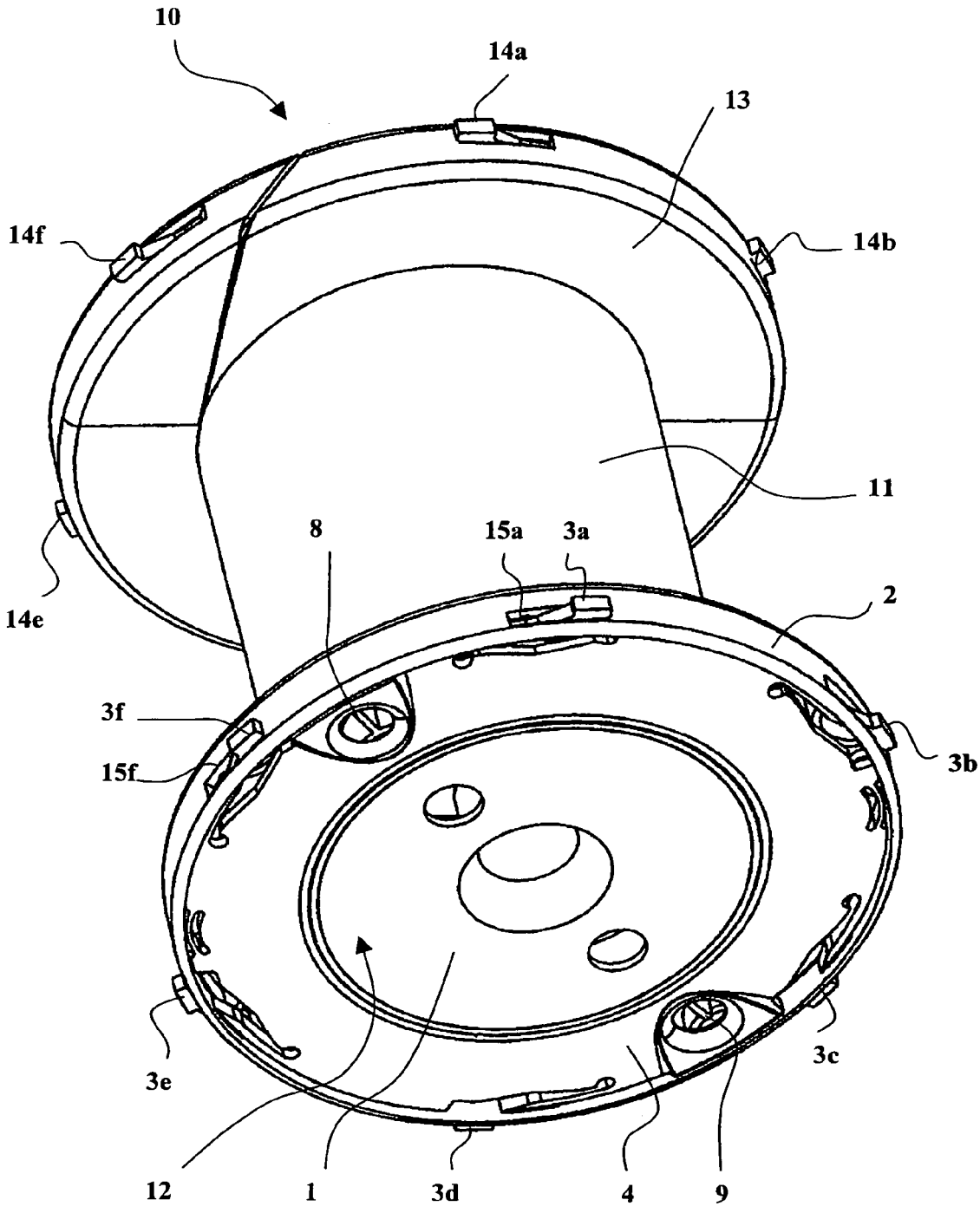
FIG. 6 is a perspective view of the FIG. 5 reel, with the radial anti-rolling projections in a projecting anti-rolling position.
Figure 7:
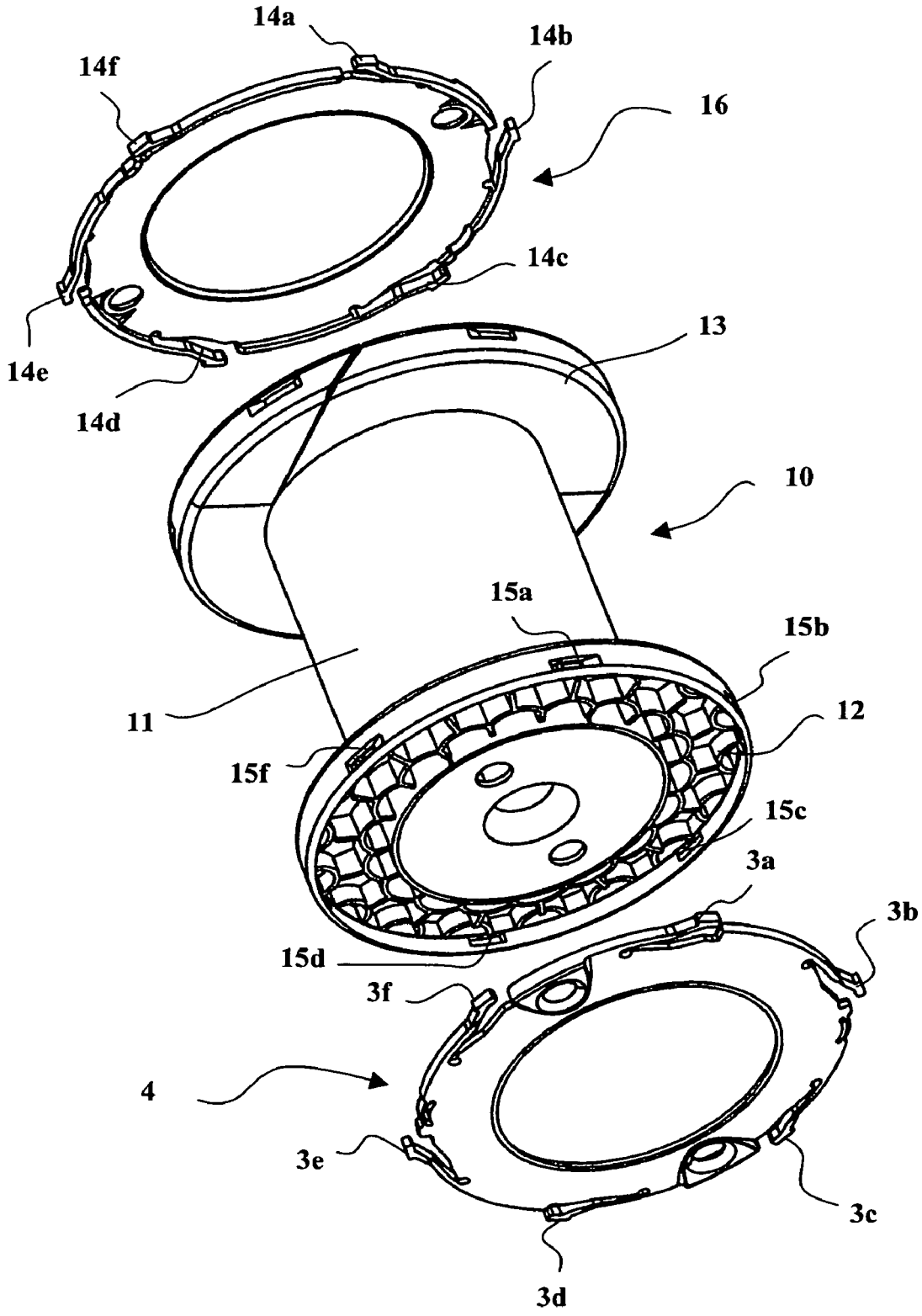
FIG. 7 is an exploded perspective view showing the components of the reel from FIGS. 5 and 6.

FIGS. 5 to 7 show the application of the invention to controlling the rolling of a wire dispensing reel.

The wire dispensing reel 10 comprises a cylindrical body 11 flanked by two end flanges 12 and 13 of larger diameter. At least one of the end flanges 12 and 13 comprises a device with anti-rolling means such as those described with reference to FIGS. 1 to 4.

In the embodiment shown in FIGS. 5 to 7, the rolling flange 1 of the device with anti-rolling means itself constitutes the end flange 12 of the wire dispensing reel 10. Thus, there is shown again the rolling flange 1 of the end flange 12 with its peripheral rolling edge 2. The coaxial controlling ring 4 disposed on the external face of the rolling flange 1 is accessible from the exterior by the holding regions consisting of the holes 8 and 9 for pivoting it by rotation about the axis of the wire dispensing reel 10. Also shown again are the leaf springs 5*a* to 5*f* and the radial anti-rolling projections 3*a* to 3*f*.

The radial anti-rolling projections 3*a*–3*f* are retracted in FIG. 5, whereas in FIG. 6, the radial anti-rolling projections 3*a*–3*f* are deployed radially and project from the peripheral rolling edge 2.

In the embodiment shown in the figures, the second end flange 13 has the same structure as the first end flange 12, and FIG. 6 shows its radial anti-rolling projections 14*a*, 14*b*, 14*e* and 14*f*. Thus, a device with anti-rolling means is fitted to each of the end flanges 12 and 13 of the wire dispensing reel 10.

In this embodiment, the retractable radial anti-rolling projections 3*a*–3*f* of the first end flange 12 are interleaved angularly between the retractable radial anti-rolling projections 14*a*–14*f* of the second end flange 13: FIG. 6 shows in particular the angular offset between the radial anti-rolling projection 3*a* and the radial anti-rolling projection 14*a* of the two end flanges 12 and 13, respectively.

FIGS. 5 and 6 also show the slots in the peripheral rolling edge 2 in which the leaf springs 5*a*–5*f* engage: note in particular the slot 15*a* through which the leaf spring 5*a* passes, or the slot 15*f* through which the leaf spring 5*f* passes.

FIG. 7 shows the wire dispensing reel 10 with its cylindrical body 11 and its two end flanges 12 and 13, the coaxial controlling ring 4 adapted to be associated with the first end flange 12, and the coaxial controlling ring 16 adapted to be associated with the second end flange 13. Also identified are the retractable radial anti-rolling projections 3*a* to 3*f*, the corresponding slots 15*a*, 15*b*, 15*c*, 15*d* and 15*f*, the radial anti-rolling projections 14*a* to 14*f* of the second coaxial controlling ring 16, and the corresponding slots in the second end flange 13 of the wire dispensing reel 10.

The present invention is not limited to the embodiments that have been described explicitly, but encompasses variants and generalizations thereof within the scope of the following claims.

The invention claimed is:

1. A device with retractable anti-rolling means, comprising a circular rolling flange delimited by a peripheral rolling edge provided with at least one radial anti-rolling projection radially movable between a deployed position and a retracted position, to oppose or selectively allow rolling of the rolling flange on a peripheral rolling edge of the rolling flange comprising a plurality of retractable radial anti-rolling projections, angularly distributed alone the periphery of the rolling flange, and simultaneously moved in a radial direction between a deployed position and a retracted position by a single controlling member that can be actuated by the user, wherein each radial anti-rolling projection comprises the external end of a respective leaf spring extending tangentially from a peripheral edge of a coaxial controlling ring and an oblique intermediate portion of which slides longitudinally in bearing engagement with guides on the rolling flange.

2. A device according to claim 1 with anti-rolling means, wherein the radial anti-rolling projections are driven in radial movement by the coaxial controlling ring mounted on a face of the rolling flange so that the rolling flange can rotate between a first angular limit position in which the radial anti-rolling projections project and a second angular limit position in which the radial anti-rolling projections are retracted within a circular contour defined by the peripheral rolling edge.

3. A device according to claim 2 with anti-rolling means, wherein the coaxial controlling ring is retained in each of its angular limit positions by rotation braking means.

4. A device according to claim 2 with anti-rolling means, wherein the coaxial controlling ring is removably fastened to the rolling flange.

5. A device according to claim 1 with anti-rolling means, wherein the radial anti-rolling projections on the flange move radially in slots in the peripheral rolling edge of the rolling flange, and the perimeters of the slots constitute said guides of the rolling flange.

6. Application of a device with anti-rolling means for controlling rolling of a wire dispensing reel comprising the wire dispensing reel having a cylindrical body flanked by two end flanges of larger diameter, at least one of said end flanges comprising said device with retractable anti-rolling means, comprising a circular rolling flange delimited by a peripheral rolling edge provided with at least one radial anti-rolling projection radially movable between a deployed position and a retracted position, to oppose or selectively allow rolling of the rolling flange on a peripheral rolling edge of the rolling flange comprising a plurality of retractable radial anti-rolling projections, angularly distributed along the periphery of the rolling flange, and simultaneously moved in a radial direction between a deployed position and a retracted position by a single controlling member that can be actuated by the user.

7. Application according to claim 6, wherein said rolling flange of the device with anti-rolling means of itself constitutes the end flange of the wire dispensing reel.

8. Application according to claim 6, wherein a device with anti-rolling means is fitted to each of the end flanges of the wire dispensing reel.

9. Application according to claim 8, wherein the retractable radial anti-rolling projections of the first end flange are interleaved angularly between the retractable radial anti-rolling projections of the second end flange.

10. A wire dispensing reel, comprising a cylindrical body flanked by two end flanges of larger diameter each with a circular peripheral rolling edge, wherein at least one of the end flanges comprises peripheral slots adapted to receive and guide leaf springs of a coaxial controlling ring of a device according to claim 5.

11. A device with retractable anti-rolling means, comprising a circular rolling flange delimited by a peripheral rolling edge provided with at least one radial anti-rolling projection radially movable between a deployed position and a retracted position, to oppose or selectively allow rolling of the rolling flange on a peripheral rolling edge of the rolling flange comprising a plurality of retractable radial anti-rolling projections, angularly distributed along the periphery of the rolling flange, and simultaneously moved in a radial direction between a deployed position and a retracted position by a single controlling member that can be actuated by the user wherein the radial anti-rolling projections are driven in radial movement by a coaxial controlling ring mounted on a face of the rolling flange so that the rolling flange can rotate between a first angular limit position in which the radial anti-rolling projections project and a second angular limit position in which the radial anti-rolling projections are retracted within a circular contour defined by the peripheral rolling edge, said coaxial controlling ring comprising leaf springs extending tangentially from the peripheral edge of the controlling ring.

* * * * *